United States Patent [19]

Wheeler

[11] 3,935,923

[45] Feb. 3, 1976

[54] TELESCOPIC ENCLOSURE

[76] Inventor: Richard T. Wheeler, 20 Hemlock Drive, Vernon, Conn. 06086

[22] Filed: Sept. 26, 1974

[21] Appl. No.: 509,544

[52] U.S. Cl. ..... 181/33 K; 181/33 GB

[51] Int. Cl.[2] ..... E04B 1/82

[58] Field of Search ..... 181/33 K, 33 GB; 312/283, 312/284, 253, 229, 257 R, 210, 286, 205, 198

[56] References Cited

UNITED STATES PATENTS

| | | | |
|---|---|---|---|
| 670,404 | 3/1901 | Davis | 312/205 UX |
| 3,820,627 | 6/1974 | Wirt | 181/33 K X |
| 3,860,085 | 1/1975 | Gilbert et al. | 181/33 K |

*Primary Examiner*—John F. Gonzales

*Attorney, Agent, or Firm*—McCormick, Paulding & Huber

[57] ABSTRACT

Inner and outer U-shaped enclosure segments are slidably mounted along tracks for movement with respect to one another in response to extension and retraction of an air cylinder. The enclosure is fabricated from sound insulating panels, with end walls being provided at the opposite ends of these tracks, and latching devices being provided for selectively securing the inner housing segment to one end wall and the other housing segment to the opposite end wall.

7 Claims, 4 Drawing Figures

TELESCOPIC ENCLOSURE

SUMMARY OF THE INVENTION

This invention relates generally to sound insulating enclosures for use in reducing the noise pollution emanating from a machine tool or the like, and deals more particularly with a telescopic enclosure especially useful for enclosinig a cold forming machine.

In constructing an enclosure for use in reducing noise at its source in a modern manufacturing facility, the general approach has been to build an enclosure around each machine tool with access openings being provided to permit the operator to get to selected portions of the machine when he is setting up a particular job, or when he is otherwise making adjustments to an automatic machine such as a machine for cold forming parts of various type.

The present invention has for its principal aim the provision of an enclosure which permits access to a major portion of the machine when one segment of the enclosure occupies a particular position, and which also permits access to the remaining portion of the machine when another segment is moved to an alternative position.

The foregoing aim of the present invention is accomplished by providing inverted U-shaped enclosure segments so sized as to fit one within another, and providing end walls for these enclosure segments such that the machine tool is completely enclosed when these inner and outer enclosure segments are latched to their respective end walls. The U-shaped segments are fabricated from sound insulating panels of monocoque construction, and a pneumatic actuator has its cylinder portion attached to the outer housing and its normally movable actuator portion attached to the inner housing. Latching means is provided for releasably securing the inner and outer housings to one of the respective end walls. The actuator can therefore be used to move either the inner housing with respect to the outer housing, or the outer housing with respect to the inner housing depending upon which latching means is secured.

DETAILED DESCRIPTION OF PREFERRED EMBODIMENT

Figure 2:
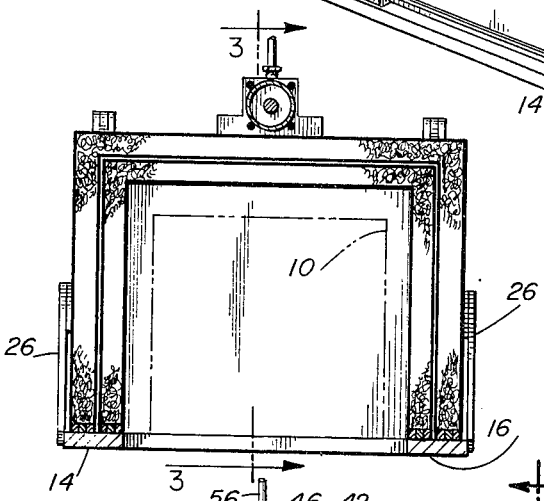
FIG. 2 is a vertical sectional view taken generally on the line 2—2 of FIG. 3.
Figure 3:
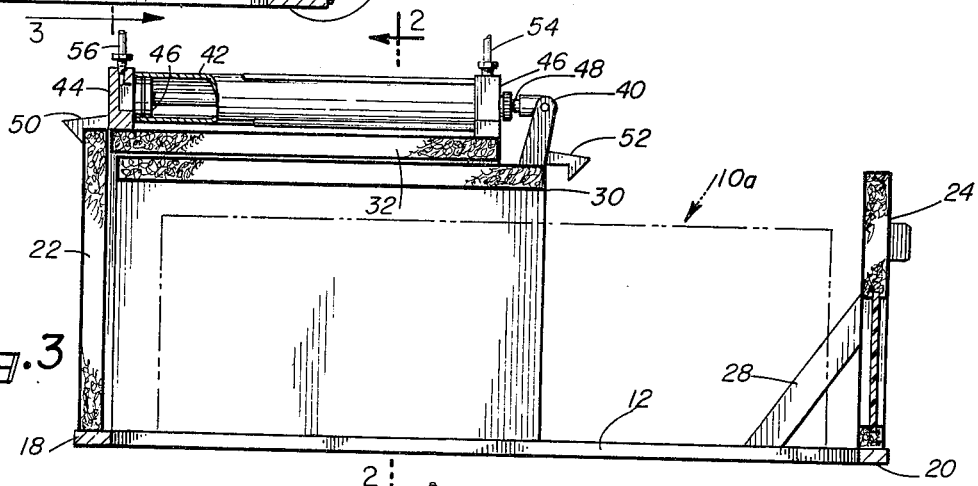
FIG. 3 is a vertical sectional view taken generally on the line 3—3 of FIG. 2 and shows the inner housing segment moved inside the outer segment.
Figure 4:
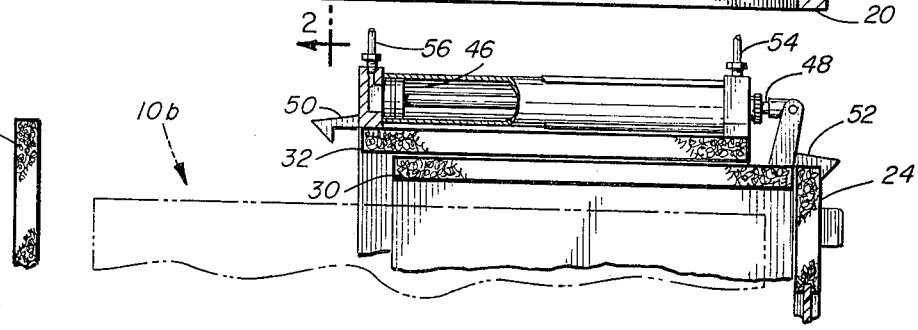
FIG. 4 is a fragmentary view showing the outer housing segment moved to a position outside that of the inner housing segment to expose the opposite end of the machine tool from that end exposed in FIG. 2.

Turning now to the drawing in greater detail, FIGS. 2, 3 and 4 show in phantom lines the general configuration of a machine tool 10, such as a conventional cold header. Such a machine may be quite noisy during its operation, and hence be a very significant contributing factor to the noise pollution in a manufacturing facility. While not necessarily so limited, the enclosure to be described is especially useful for isolating noise pollution originating from a machine tool of the cold header type; but, it will be obvious to those skilled in this art that the general concept disclosed herein might also be adapted to the construction of enclosures for other noisy machines.

It will be apparent that there is a need in many such machines for the operator to have access, not only to the portion of the machine indicated generally by reference numeral 10*a*, but also for the operator to have access to the opposite end portion of the machine tool, such as shown generally at reference numeral 10*b* in FIG. 4. FIG. 2 shows the cross-sectional configuration of the machine tool 10 in phantom lines, and also illustrates the general internal arrangement of the telescopic enclosure itself.

Figure 1:
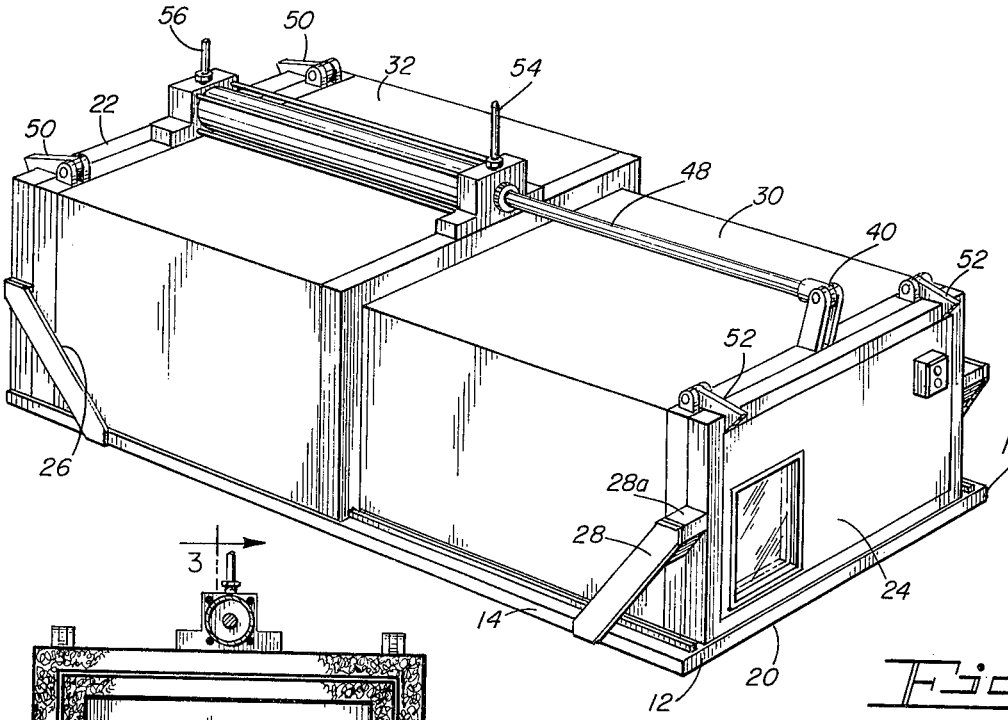
FIG. 1 is a perspective view illustrating the overall configuration of a telescopic enclosure incorporating the present invention, the movable housing segments thereof being shown in position for completely enclosing the machine tool or source of noise to be isolated.

Still with reference to FIGS. 2 and 3, the various components of the telescopic enclosure which are to be described comprise hollow shell-like monocoque elements, that is, each element of the enclosure comprises a generally rectangular panel with inner and outer skins of sheet metal or the like, the interior of which panels is preferably filled with a sound insulating material, such as mineral wool or the like, with the result that when the enclosure segments are in the positions depcited in FIG. 1, the sound from the machine tool 10 will be significantly reduced outside of the enclosure. Additionally, the machine will be rendered much safer in operation, and it should be noted that an interlock system could be employed to render the machine operative unless limit switches associated with the enclosure components were activated to complete an enabling circuit associated with the machine's control circuit.

Turning next to a more detailed description of the enclosure itself, a generally rectangular base 12 is provided for the enclosure and includes longitudinally extending side rails or tracks 14 and 16 which extend along the side of the generally rectangular base 12 or frame. The shorter sides of the base, or frame, 12 provides a fixed support 18 for the rear end wall 22 and the opposite side 20 of the frame supports the front end wall 24 as best shown in FIG. 3. In order to further aid in the support of these end walls 22 and 24 gusset plates or angle brackets 26 and 28 are provided to maintain these end walls 22 and 24 respectively in their upright configurations. Thus, the end walls 22 and 24 are rigidly secured to opposite end portions of the rail or track defining longitudinally extending parallel sides 14 and 16 of the base or frame 12.

The above-described components comprise the fixed structural portion of the enclosure, and the portion to be described comprises the movable elements or components thereof. Prior to describing these movable portions of the enclosure, however, it should perhaps be noted that the rectangular frame 12 may or may not be required and that the longitudinally extending tracks or rails might instead be attached directly to a floor or the like upon which the machine tool 10 is already provided. It should also be noted that the gussets 28, 28 might be then provided so that the lower end portion thereof extends outwardly beyond the end wall 24, in which case the portion 28*a* required for spacing these gussets or braces 28, 28 outwardly from the edge of the end wall 24 would not then be required. Instead, the rail or track 14 would be extended beyond the end wall 24, and the triangular element 28 would be oriented oppositely from the configuration shown in FIGS. 1 and 3.

In accordance with the present invention, the overall enclosure shown in FIG. 1 also includes inner and outer housing segments 30 and 32 respectively each of which is of inverted U-shaped configuration having a top wall and generally vertically extending side walls connected to one another at right angles by any convenient means. The outer U-shaped housing 32 is of slightly larger size than the inner housing 30 so that the latter nests within the former at least when the housing members are placed in the positions shown for them in FIG. 3. In the FIG. 3 position, one half 10*a* of the machine tool 10 is exposed for set-up or for any purpose. FIG. 2 also shows the nesting arrangement for said U-shaped segments, and FIG. 4 shows the alternative limit position for each of these segments wherein the opposite end or half 10*b* of the machine tool is exposed.

The vertically extending side walls of each of the inverted U-shaped housings as well as the top walls thereof, and the end walls discussed previously are all fabricated from a sound insulating material preferably in a monocoque construction wherein each panel is provided with inner and outer metal sheaths, and wherein a suitable sound insulatory material such as mineral wool is provided therebetween. Other suitable insulating material might also be adapted for use in these panels, and the outer skin might comprise either galvanized steel or aluminum or some such similar substance.

In further accordance with the present invention, power means is preferably provided for movement of both housing segments between the limit positions shown for them in FIGS. 3 and 4 respectively. Preferably, said power means comprises a pneumatic actuator with its cylinder part carried by the outer housing segment 32, as best shown in FIGS. 1 and 3, and its normally movable part, or actuator rod connected to the inner housing segment 30 as shown generally at 40 in FIGS. 1 and 3. The pneumatic actuator comprises a conventional fluid motor having an elongated cylindrical portion 42, the opposite ends of which, 44 and 46, are connected to the top wall of the outer housing 32. A piston 46 is slidably received in the cylindrical housing 42, and the actuating rod 48 is movable in response to movement of the piston, thereby causing movement of the inner housing segment 30 with respect to the outer housing segment 32 in one and opposite direction. This movement is possible because both segments are slidably received on their associated tracks or slides 14 and 16. These housing segments 30 and 32 are selectively movable, a rear pair of latches 50, 50 being adapted to be set as shown in FIGS. 1 and 3 and a front set of latches 52, 52 to be opened manually so as to permit fluid under pressure in line 54 to move the piston 46 toward the left as shown in FIG. 3 with the result that the inner housing segment 30 moves rearwardly underneath the outer housing, exposing the righthand portion 10*a* of the machine tool. On the other hand, and as suggested in FIG. 4, release of latches 50, 50 and setting of latches 52, 52 permit the outer housing to move with respect to the inner housing with the result that the left-hand portion 10*b* of the machine tool is exposed. The last mentioned movement of the outer housing 32 with respect to the inner housing 30 is accomplished by providing fluid under pressure in the same line 54, line 56 being provided to achieve return movement of the housing segments from the positions shown in FIGS. 3 and 4 respectively toward their enclosure defining positions as depicted in FIG. 1. In this FIG. 1 position, both sets of latches 50 and 52 are preferably set to prevent inadvertent movement of these housing segments 30 and 32.

In conclusion then the enclosure described herein is designed to reduce the noise levels of the machine housed therein, but other advantages also attach to this enclosure configuration. Perhaps most significant is the fact that this enclosure is designed to permit access to the entire machine merely by telescoping the enclosure segments. This feature obviously facilitates work set-up and maintenance work on the machine, reducing machine downtime below that possible with more conventional enclosures. Additionally, this enclosure configuration permits the machine to be freed from any prior art safety gate or cover, with its associated interlock system, provided only that the user fit a similar interlock system to this enclosure configuration. In so doing he will not only have a more effective system safety wise, but he will also have a quietor environment, a factor which itself contributes to the overall safety of his personnel generally.

I claim:

1. An enclosure for reducing the noise pollution caused by a machine tool or the like, said enclosure comprising:

a. an outer housing of inverted U-shape configuration having a top wall and generally vertically extending side walls, b. an inner housing also of inverted U-shaped configuration and also having a top wall and vertically extending side walls, c. longitudinally extending inner and outer sets of tracks for slidably receiving said inner and outer housings such that said housings are movable with respect to one another between telescoped and extended positions, d. end walls carried by said tracks for closing opposite ends of said inner and outer housings when each is in its extended position with respect to the other, whereby an enclosure is defined for the machine tool, e. means for moving said housings with respect to one another and comprising a first part carried by said outer housing and a second part movable with respect to the first and carried by said inner housing, and f. latching means for releasably securing said outer housing to one of said end walls and said inner housing to the other of said end walls.

2. An enclosure for reducing the noise pollution caused by a machine tool or the like, said enclosure comprising:

a. an outer housing of inverted U-shape configuration having a top wall and generally vertically extending side walls, b. an inner housing also of inverted U-shaped configuration and also having a top wall and vertically extending side walls, c. longitudinally extending inner and outer sets of tracks for slidably receiving said inner and outer housings such that said housings are movable with respect to one another between telescoped and extended positions, d. end walls carried by said tracks for closing opposite ends of said inner and outer housings when each is in its extended position with respect to the other, whereby an enclosure is defined for the machine tool, e. power means for so moving said housings, said power means comprising a fluid motor with one part carried by said outer housing and a second part movable with respect to the first and carried by said inner housing.

3. The enclosure of claim 2 wherein said tracks are floor mounted and each set thereof slidably receives the lower longitudinal edges of the side walls of said inner and outer housings.

4. The enclosure of claim 2 wherein said end walls comprise vertically oriented rectangular panels, the lower edges of said panels being connected to said tracks, and at least one gusset bracket associated with each housing, one edge of each of said brackets being connected to one of said tracks and the other edge of said bracket being connected to said panel end wall.

5. The enclosure of claim 4 wherein said top walls and said side walls of said inner and outer housings also comprise generally rectangular panels, all of said panels being of monocoque construction each having a hollow interior filled with sound absorbing material.

6. The enclosure of claim 2 further characterized by first latching means for releasably securing said outer housing to one of said end walls.

7. The enclosure of claim 6 further characterized by second latching means for releasably securing said inner housing to the other of said end walls.

* * * * *